US006976763B2

(12) United States Patent
Robbins, III

(10) Patent No.: US 6,976,763 B2
(45) Date of Patent: Dec. 20, 2005

(54) LUMINESCENT AND FLUORESCENT STRIP DOOR HIGHLIGHTS

(76) Inventor: Edward S. Robbins, III, 128 Hazelwood La., Florence, AL (US) 35630

( * ) Notice: Subject to any disclaimer, the term of this patent is extended or adjusted under 35 U.S.C. 154(b) by 43 days.

(21) Appl. No.: 10/716,235

(22) Filed: Nov. 18, 2003

(65) Prior Publication Data

US 2004/0212986 A1 Oct. 28, 2004

Related U.S. Application Data

(60) Provisional application No. 60/465,370, filed on Apr. 25, 2003.

(51) Int. Cl.[7] ..... F21V 33/00

(52) U.S. Cl. ..... 362/84; 362/234; 362/260; 160/330

(58) Field of Search ..... 362/253, 84, 234, 362/260, 145, 153, 151, 152; 160/330, 332, 160/184

(56) References Cited

U.S. PATENT DOCUMENTS 4,095,642 A 6/1978 McKinnon et al.
4,165,778 A 8/1979 Smith
4,232,725 A 11/1980 Gidge
4,234,907 A * 11/1980 Daniel ..... 362/556
4,257,471 A 3/1981 Thurmond, Jr.
4,289,190 A 9/1981 Catan
4,312,396 A 1/1982 McKinnon et al.
4,330,177 A 5/1982 Miller et al.
4,377,750 A 3/1983 Pape et al.
4,401,050 A * 8/1983 Britt et al. ..... 116/205
4,607,678 A * 8/1986 Pomaville et al. ..... 160/332
4,965,701 A * 10/1990 Voland ..... 362/565
5,127,460 A 7/1992 Abadi et al.
5,343,375 A * 8/1994 Gross et al. ..... 362/248
5,412,553 A * 5/1995 Wojski ..... 362/253
5,724,909 A 3/1998 Pitman et al.
5,904,017 A 5/1999 Glatz et al.
5,944,139 A * 8/1999 Kozial ..... 182/92
5,967,644 A * 10/1999 Pan ..... 362/249
6,123,871 A 9/2000 Carroll
6,126,298 A * 10/2000 Wu ..... 362/252
6,213,437 B1 4/2001 Robbins
6,234,801 B1 5/2001 Hsu
6,237,266 B1 5/2001 Tassey et al.
6,276,634 B1 8/2001 Bodle
6,307,207 B1 10/2001 Burbank
6,358,563 B1 3/2002 van Duynhoven
6,375,864 B1 4/2002 Phillips et al.
6,394,171 B1 5/2002 Robbins, III
6,431,730 B1 * 8/2002 Deutsch et al. ..... 362/252
6,474,983 B1 11/2002 Robbins
6,550,929 B1 * 4/2003 Dumas ..... 362/84

* cited by examiner

*Primary Examiner*—Thomas M. Sember
(74) *Attorney, Agent, or Firm*—Brinks Hofer Gilson Lione

(57) ABSTRACT

A margin highlighter is fixed to a strip curtain-holding apparatus and positioned adjacent to one of the lateral or upper margins. The margin highlighter including a luminescent agent in sufficient concentration to provide a visible light emission in the event of lighting failure, the luminescent agent having a color in the range of about 500 to 650 nm.

23 Claims, 9 Drawing Sheets

LUMINESCENT AND FLUORESCENT STRIP DOOR HIGHLIGHTS

RELATED APPLICATIONS

The present patent document claims the benefit of the filing date of Provisional U.S. Patent Application Ser. No. 60/465,370 filed Apr. 25, 2003, which is hereby incorporated by reference.

BACKGROUND

The present invention pertains generally to industrial curtains and doors used as environmental closures for openings through which traffic can still pass. The curtains generally comprise a plurality of usually transparent strips that are suspended contiguously to each other from a hanger or support generally fixed adjacent to a top margin of the opening. Each of the strips usually consists of a length of flexible, generally transparent, material terminating adjacent to a lower margin of the opening. The present invention relates particularly to improvements that will provide enhanced margin visibility particularly in low light situations.

Strip curtains and doors are conventionally employed to provide closures between, for example, separate manufacturing areas within large buildings, warehouses and the like. Goods are often required to be transported from one area of a manufacturing or storage facility to another where one or the other of the areas is heated, air-conditioned or even refrigerated. On occasion, other environmental concerns need to be addressed such as dust, fumes, smoke, dirt, or even noise. Where the traffic is only occasional, conventional doors can be employed to close any doorway between the two areas. Where the traffic is considerable, the use of conventional doors gives way to suspended flexible screens or curtains, which inhibit the wholesale transfer of air from one area to the other yet still permit goods-transporting vehicles such as fork lifts to pass through with little effort.

The doors and curtains are generally made of elongated plastic strips that hang side-by-side from a support system mounted to extend across the top of the opening. For safety reasons, it is desirable that the curtain be sufficiently transparent that one operating a transporting vehicle be able to see any hazard or obstruction that might exist on an opposite side of a curtain before proceeding through. Persons on the opposite side of a curtain also desire to be able to see oncoming transport vehicles so appropriate evasive action can be taken. Thus, plastic materials, which were more or less transparent, such as polyvinyl chloride and polyethylene, were adopted as the preferred materials for forming such screens as shown, for example, in U.S. Pat. Nos. 4,095,642, 4,165,778, 4,232,725, 4,289,190, 4,607,678, 5,127,460, and 6,394,171.

U.S. Pat. No. 4,312,396 discloses that the strips forming such doors can be transparent, opaque, or in any desired color, depending on the expected use. As a practical matter, however, opaque strips running the full vertical length of a door inhibit the visibility needed by transportation vehicle operators and others as previously indicated. When used a doors, transportation equipment operators have found it desirable for some of the strips in strip curtain doors, such as the outer edge strips or a center divider strip, to be made of a contrasting or different color for delineating either the sides of the opening or the center of a passageway, or both as suggested by U.S. Pat. No. 4,257,471. This has typically been carried out by incorporation a tinting agent in the plastic forming the colored strips that only minimally reduces the transparency of the strips.

While such colored strips perform adequately in well lighted situations to identify the sides of a doorway opening, the differences in color become difficult to discern in low light situations. Further no attention has been paid to the overhead margin of the doorway opening, which can be quite important to vehicles that have a variable height requirement.

BRIEF SUMMARY OF INVENTION

Accordingly, the present invention is directed to an environmental curtain system for at least partially obstructing a passage that is defined by an upper margin and two lateral margins. The system includes a curtain-holding apparatus to be fixed adjacent to the upper margin of the passage for suspending a plurality of flexible transparent strips of the curtain in the passage. The curtain-holding apparatus can be any of a number of designs, including any of the designs disclosed in my earlier filed application PCT/US03/05964. Each of the flexible transparent strips has an upper end fixed to the curtain-holding apparatus and a lower end adjacent to a lower margin of the passage such as the floor. The curtain system also includes a margin highlighter fixed to the curtain-holding apparatus and positioned adjacent to one or more of the lateral or upper margins of the passage.

The margin highlighter can include a luminescent agent in sufficient concentration to provide a visible light emission in the event of lighting failure resulting in a significant reduction in overall visibility so that the margin of the passage remains apparent. The luminescent agent preferably has a color in the range of about 500 to 650 nm to enhance its visibility even in low light conditions. The luminescent strip can be formed as a matrix of plasticized PVC or other substantially transparent polymer and a phosphorescent pigment loading of from 0.5% to 30%. The incorporation of the phosphorescent pigment allows the margin highlighter to glow and become visible in reduced light or darkness. The phosphorescent pigments absorb light energy from daylight and artificial lighting, and release it in certain wavelengths in reduced light or darkness.

The margin highlighter can also include a fluorescent pigment that allows the highlighter to vividly stand out even in reduced light situations. The fluorescent margin highlighter can be formed as a matrix of plasticized PVC or other substantially transparent polymer and a fluorescent pigment loading of from 0.5% to 30%. While the light emission of a non-fluorescent colorant generally cannot exceed about 10% of its specific wavelength, when a fluorescent color is utilized, the light emission exceeds 10% and can be as much as 300% under certain lighting conditions. This higher light emission is definitely a safety enhancer when used margin highlighters of the present invention.

The margin highlighter can take a variety of shapes. A margin highlighter for the upper margin can take the form of a plurality of elements extending downward from the curtain-holding apparatus by between about 3 cm and 30 cm. The upper margin highlighter can have the form of vertically arranged bands overlying the transparent strips of the curtain system. The upper margin highlighter can also have the form of a single horizontal band fixed to the strip holding portion of the curtain-holding apparatus. The upper margin highlighter can also have the form of discrete elements fixed to each of the strip holding elements of the curtain-holding apparatus. The upper margin highlighter can also have the form of the curtain-holding apparatus itself being made of, or coated with, a polymer having a luminescent agent and/or fluorescent agent.

A margin highlighter for a lateral margin of the passage can take the form of a geometric pattern of luminescent or fluorescent agent containing bodies fixed to an otherwise transparent strip, the pattern being selected to leave sufficient transparent portions of the strip to maintain sufficient visibility through the strip to observe therethrough any occurrence of movement. The geometric pattern can take the form of horizontal, diagonal or vertical stripes or waves, chevrons, checks, cross-hatches, as well as other pattern. The geometric pattern can be created by lamination, co-extrusion, or other well known processes. Preferably, the surface area of the luminescent agent portions is less than the surface area of the transparent portions of the strips forming the lateral margin highlighter.

Any of the embodiments can be made from suitable plastics incorporating visibility enhancing materials such as are disclosed in U.S. Pat. Nos. 5,674,437; 5,904,017; 6,123,871 and 6,375,864 as well as in the prior art therein identified and/or discussed.

Additional features and advantages of the present invention will become apparent to those skilled in the art from a consideration of the following discussion of preferred embodiments that referenced the accompanying drawings.

DESCRIPTION OF PREFERRED EMBODIMENTS

Figure 1:
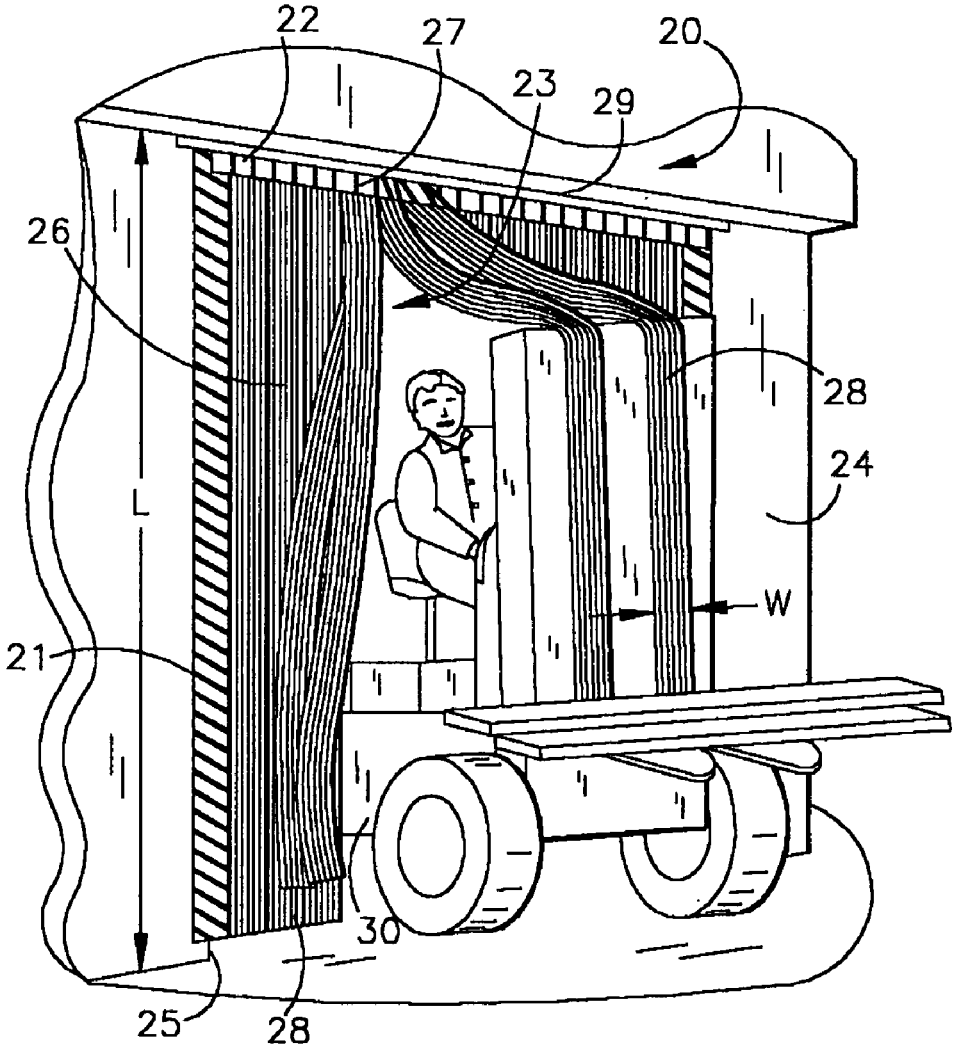
FIG. 1 is a perspective view of an environmental strip curtain system of the present invention.

FIG. 1 shows a perspective view of an environmental strip curtain system 20 that incorporates highlighting features 21 and 22 of the present invention. The curtain system 20 is fixed adjacent a passage 23 through a wall 24, the passage being defined in part by lateral margins 25. The strip curtain system 20 includes a strip curtain 26 comprising a plurality of flexible transparent strips 28, each strip of width W and length L suspended on the curtain holding apparatus 27, usually in an overlapping pattern. The curtain holding apparatus 27 is fixed adjacent to an overhead margin 29 of the passage 23. The strips 28 are sufficiently flexible that transportation vehicles 30, such as fork lifts, can move through the passage 23 in wall 24 by displacing the strips 28 as shown in FIG. 1. The general nature and use of such environmental curtain systems 20 are well known, and the present invention is directed at enhancing the visibility of the margins 25 and 29 using overhead highlighters 22 and lateral highlighters 21 as further described herein.

Figure 3:
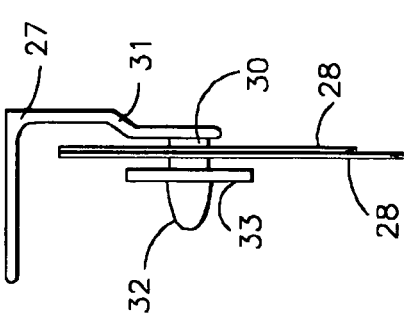
FIG. 3 is a side elevation of the apparatus shown in FIG. 2.
Figure 2:
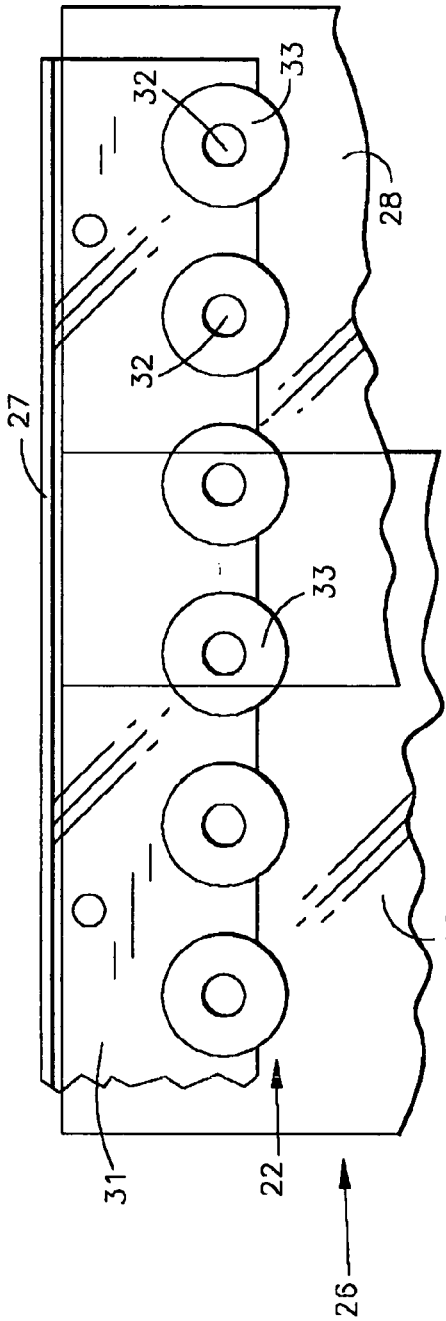
FIG. 2 is a front elevation of a first curtain-holding apparatus and including an upper margin highlighter of the present invention.

FIGS. 2 and 3 show a holding apparatus 27 that includes a plurality of forwardly projecting pegs 30 coupled to bar 31. Each of the pegs includes an end cap 32 that is somewhat larger in size than the corresponding peg 30. A fuller description of hardware of this type is to be found in my earlier international application PCT/US03/05964. A plurality of transparent strips 28 can form a strip curtain 26. Each of the strips 28 can include a plurality of holes permitting the strips 26 to be impaled over the end caps 32 and onto pegs 30.

An upper margin highlighter 22 of the present invention can take the form of a plurality of discrete discs 33, each disc having a central opening permitting the disc 33 to be impaled over the end cap 32 and onto peg 30 after installation of the plurality of strips 28 forming the strip curtain 26. The discs 33 can each have a diameter of about 3 cm or more. The discs 33 can include a luminescent agent and/or a fluorescent agent as identified previously. The discs 33 are preferably brightly colored so as to make the upper margin 29 of any passage 23 to which the holding apparatus 27 is mounted highly visible regardless of the lighting situation.

Figure 5:
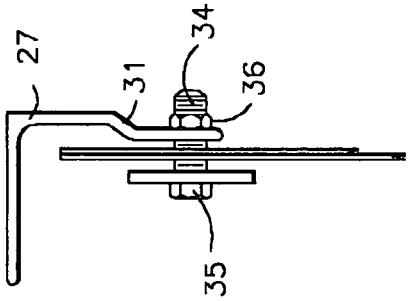
FIG. 5 is a side elevation of the apparatus shown in FIG. 4.
Figure 4:
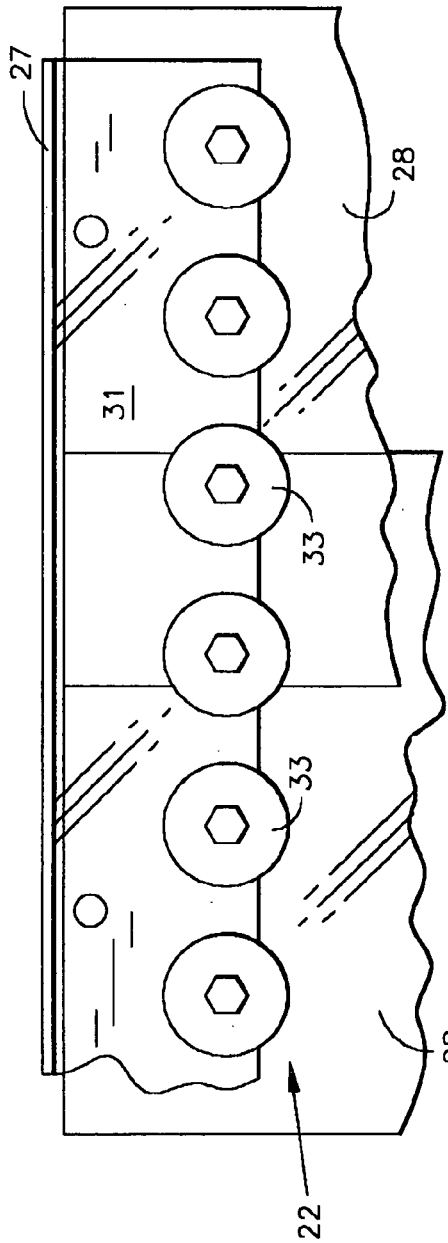
FIG. 4 is a front elevation of a second curtain-holding apparatus including the upper margin highlighter of FIG. 2.

FIGS. 4 and 5 show an alternative embodiment for the holding apparatus 27 that includes plurality of threaded fasteners 34 with heads 35 permitting attachment of the threaded fasteners 34 to bar 31 with nuts 36 that can be fixed to a back surface of the bar 31. The upper margin highlighter 22 can again be in the form of discs 33 containing a luminescent agent and/or a fluorescent agent as identified previously, which are placed onto the threaded fastener 34 adjacent to the head 35. The threaded fastener 34 can then be pushed through the openings in the strips 28 of the strip curtain 26 and then engaged in threaded nuts 36 that are fixed to bar 31. The visual effect of the discs 33 forming the upper margin highlighter 22 in the embodiment shown in FIGS. 4 and 5 can be substantially identical to that shown in FIGS. 2 and 3.

Figure 6:
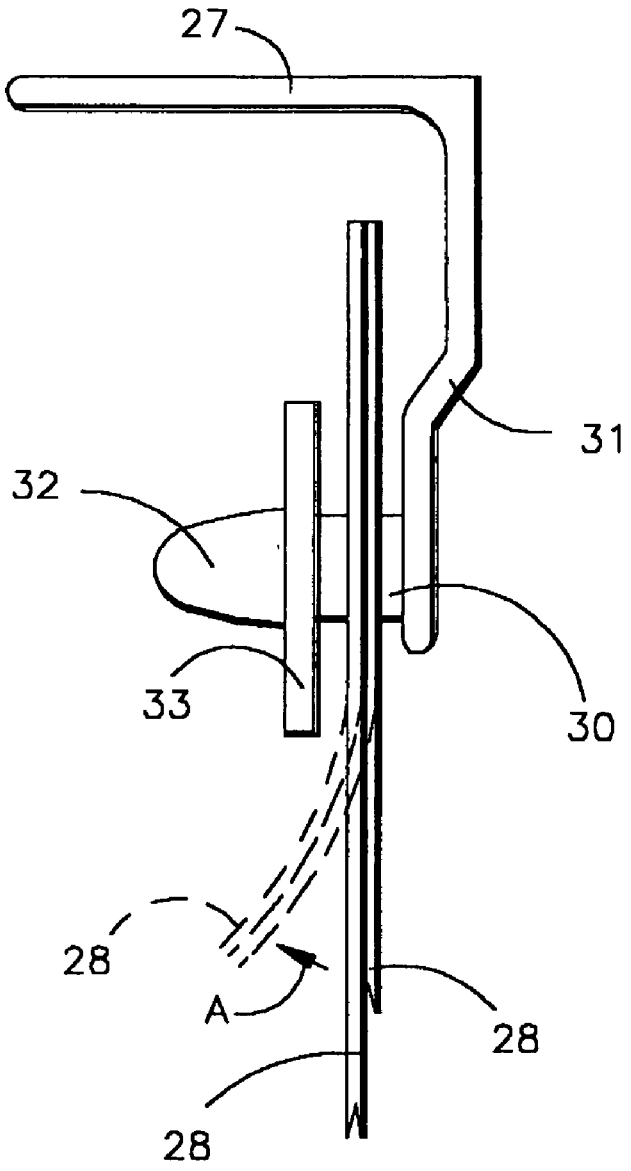
FIG. 6 is a detail view similar to FIG. 3 showing movement of the transparent strips.

As shown in FIG. 6, displacement of the strips 28 in the direction of arrow A due to movement of transportation vehicles 30 or other equipment through the curtain 26 can cause displacement of the strips 28 to the position shown in phantom. Even under extreme movement, the discs 33 forming the upper margin highlighter 22 can act as a buffer preventing direct interaction of the strips 28 with the back surface of the end cap 32 thus, reducing any tendency for damage to the strips 28 by virtue of such repeated displacement.

Figure 8:
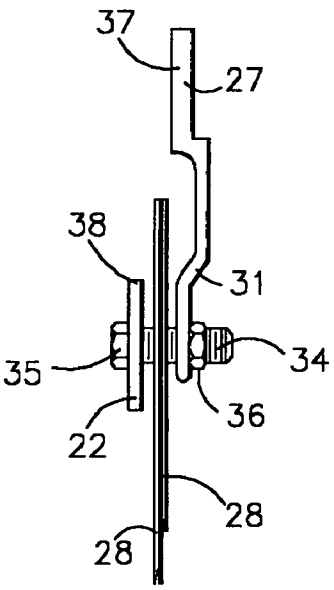
FIG. 8 is a side elevation of the apparatus shown in FIG. 7.
Figure 7:
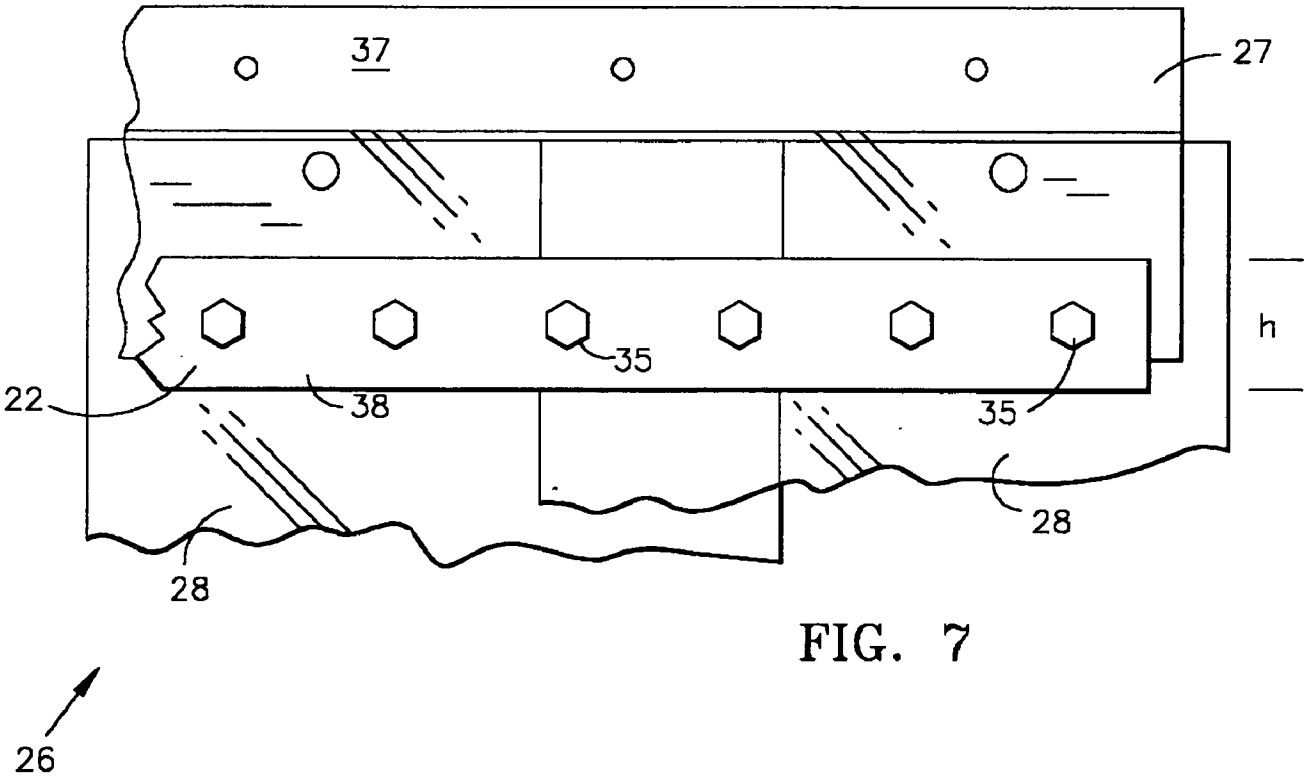
FIG. 7 is a front elevation view of a third curtain-holding apparatus including another upper margin highlighter embodiment.

FIGS. 7 and 8 show an alternative embodiment for a holding apparatus 27 in which an upper portion 37 of the apparatus is intended to be secured to a vertical surface rather than a horizontal surface as in the embodiments shown in FIGS. 2–6. The holding apparatus 27 in FIGS. 7 and 8 can include the threaded fasteners 34 with heads 35 as shown previously in connection with FIGS. 4 and 5. The upper margin highlighter 22 can take the form of a horizontally elongated bar 38 containing a luminescent agent and/or a fluorescent agent as identified previously and having a plurality of openings to receive the plurality of threaded fasteners 34. The bar 38 can have a vertical dimension h of about 3 cm or more, and a horizontal dimension limited merely by the overall width of the strip curtain 26. The bar 38 can be formed by an extrusion process and pre-punched at the desired spacing for the fasteners 34. The extruded bar 38 can be rolled lengthwise to provide easy handling prior to installation.

Figure 10:
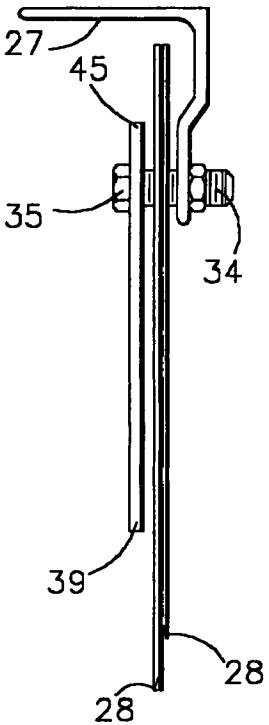
FIG. 10 is a side elevation of the apparatus shown in FIG. 9.
Figure 9:
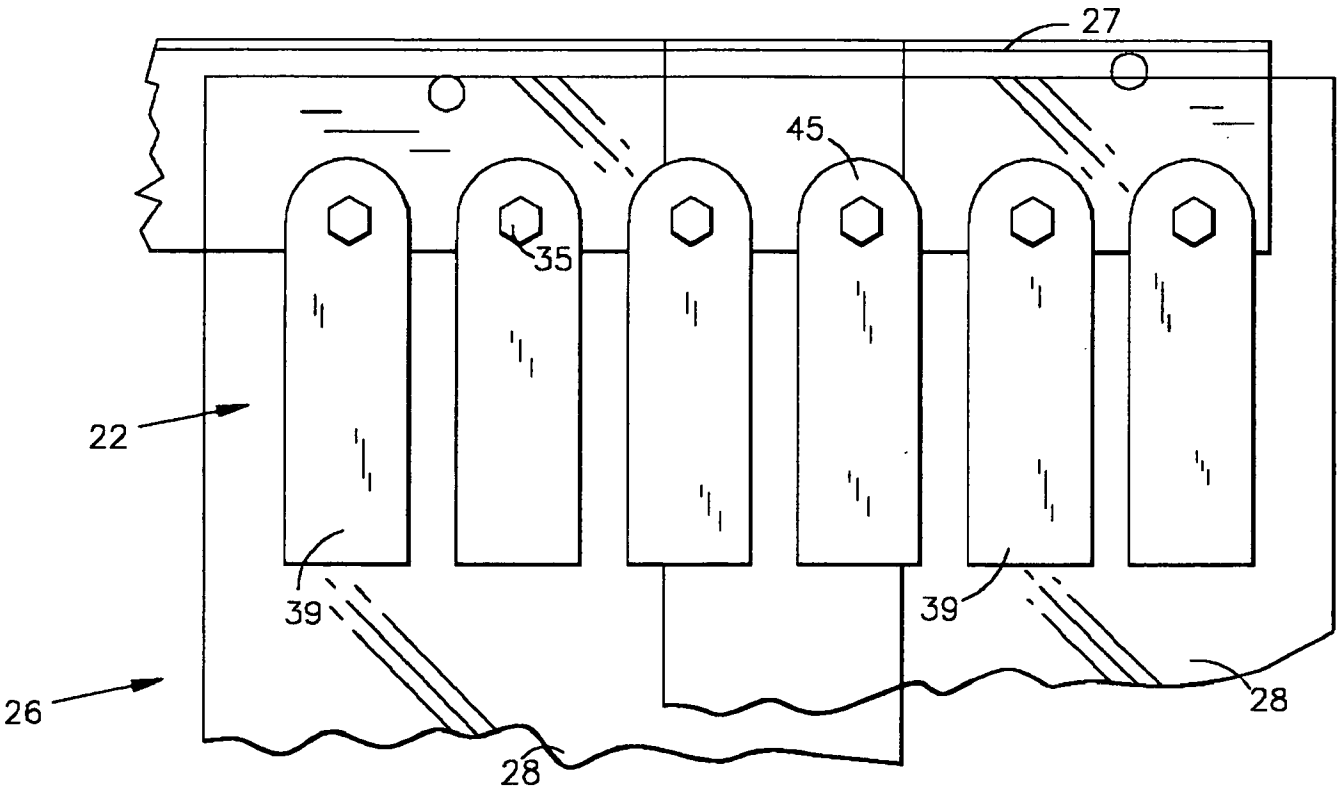
FIG. 9 is a front elevation view of the apparatus shown in FIG. 4 with another embodiment of an upper margin highlighter.

A holding apparatus 27 similar to that shown in FIGS. 4 and 5 is again shown in FIGS. 9 and 10 together with plurality of strips 28 forming a strip curtain 26. The upper margin highlighter 22 can take the form of a plurality of vertically elongated bars 39 containing a luminescent agent and/or a fluorescent agent as identified previously. The vertically elongated bars 39 can have an opening in an upper end 45 designed to receive one of the threaded fasteners 34. The method of assembling of the upper margin highlighter 22 shown in FIGS. 9 and 10 can be similar to that of the discs 33 shown in FIGS. 4 and 5. The vertically elongated bars 39 can have the advantage of extending downward by a distance sufficient to extend at least down to if not into the passage 23. The vertical dimension of the vertically elongated bars 39 can be from at least 3 cm up to about 30 cm.

Figure 12:
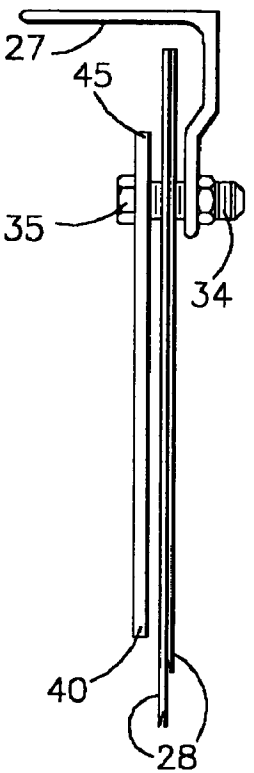
FIG. 12 is a side elevation of the apparatus shown in FIG. 11.
Figure 11:
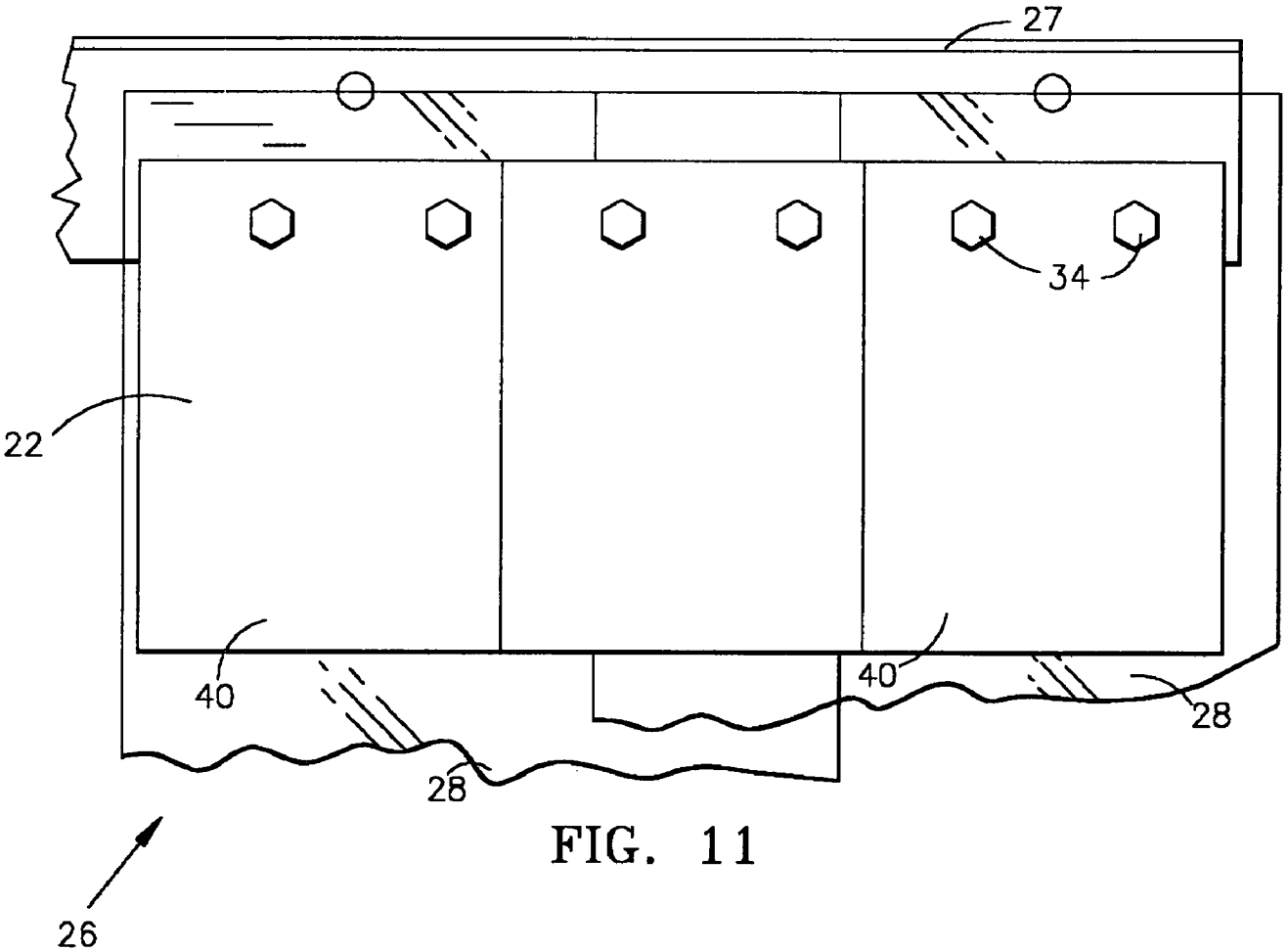
FIG. 11 is a front elevation view of the apparatus shown in FIG. 4 with yet another embodiment of an upper margin highlighter.

FIGS. 11 and 12 show a strip curtain holding apparatus 27 as described previously in connection with FIGS. 9 and 10 with yet another embodiment of an upper margin highlighter 22. In this embodiment, the upper margin highlighter 22 takes the form of rectangular pads 40 containing a luminescent agent and/or a fluorescent agent as identified previously and having a plurality of openings for receiving two or more fasteners 34. Again, the vertical dimension of the rectangular pads can be up to 30 cm in length. Of course, it will be appreciated that in both of the embodiments shown in FIGS. 9–12, the vertical dimension of the upper margin highlighters 22 should not be greater than that necessary to alert machine operators to the presence of the upper margin of the passageway and should not be long enough to obstruct the view of the machine operator through the transparent strips 28.

Figure 13:
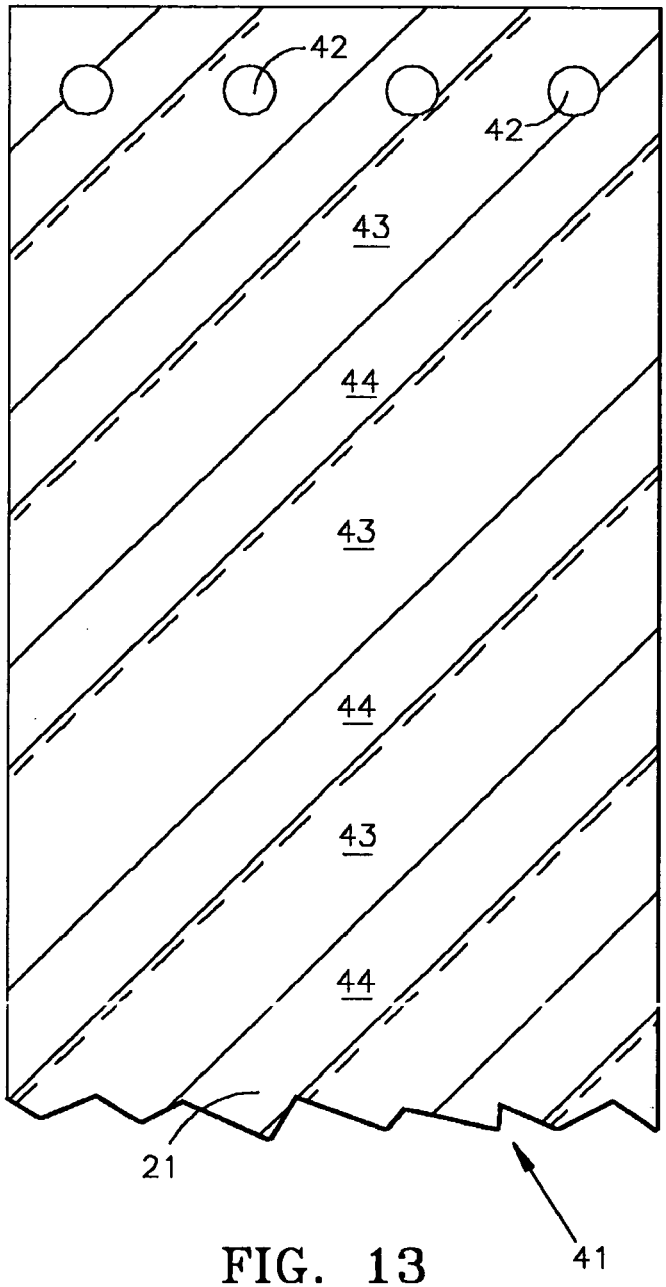
FIG. 13 is a front elevation view of a lateral margin highlighter of the present invention.
Figure 14:
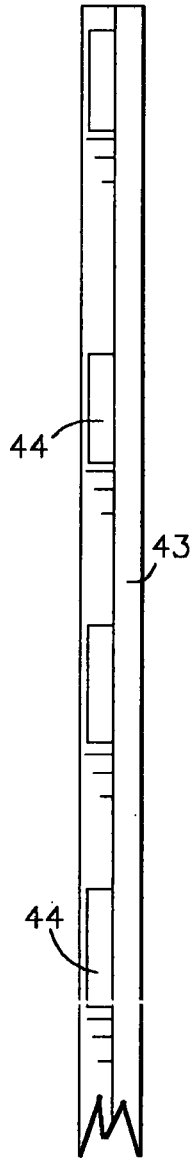
FIG. 14 is a side elevation of the highlighter of FIG. 13.

FIGS. 13 and 14 show a lateral margin highlighter 21 in the form of a vertical strip 41 including a series of openings 42 to permit engagement with one of the strip holding apparatus 27 previously described. The vertical strip 41 includes transparent portions 43 separated by more translucent or opaque portions 44 containing a luminescent agent and/or a fluorescent agent as identified previously. It will be noted that the transparent portions 43 can be larger in area than the portions 44 including the luminescent and or fluorescent agents, thereby ensuring a sufficient measure of transparency of the strip 41 to retain the ability to see motion through the strip. The luminescent and/or fluorescent agent containing portions 44 can be secured to a continuous strip of transparent material 43 a shown in FIG. 14. While FIG. 13 shows the pattern of the luminescent containing portions 44 to constitute diagonal stripes, other patterns including horizontal or vertical stripes, waves, chevrons, checks, and crosshatches, etc. are possible.

Figure 16:
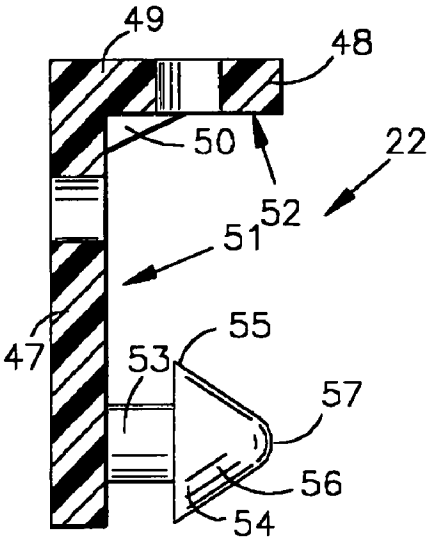
FIG. 16 is a sectional view taken along line 16—16 of the apparatus shown in FIG. 15.
Figure 15:
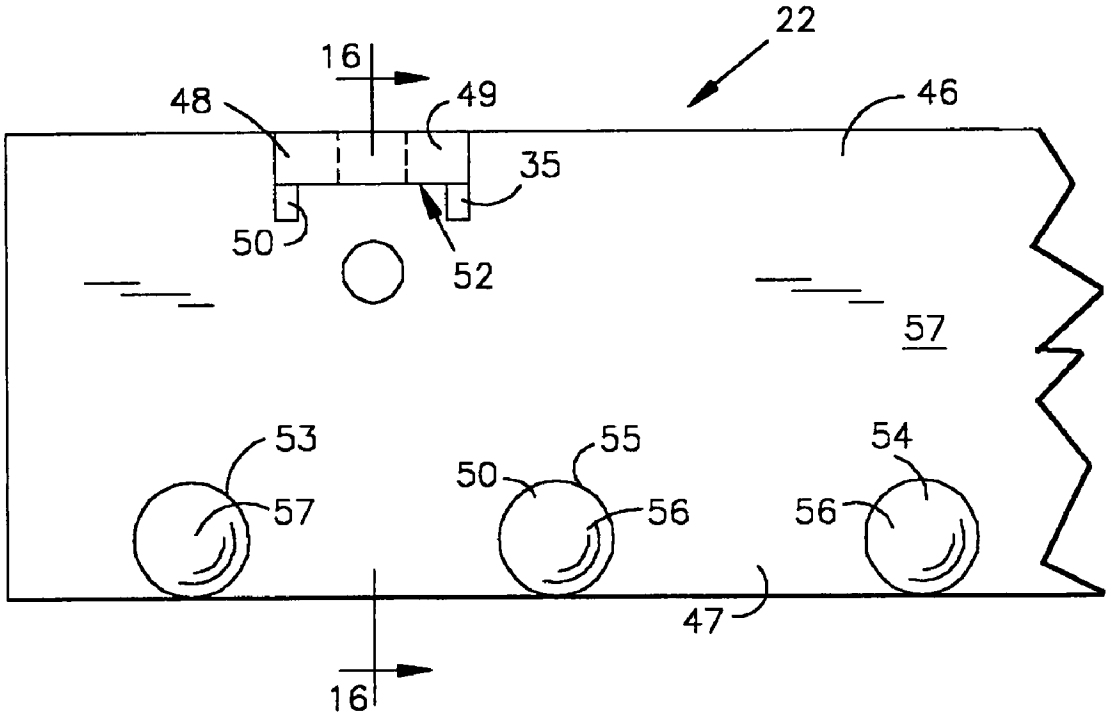
FIG. 15 is a front elevation view of another curtain-holding apparatus constituting an upper margin highlighter embodiment.

FIGS. 15 and 16 show another form of an upper margin highlighter 22. In this embodiment, the upper margin highlighter 22 takes the form of a strip curtain supporting structure 46 that is molded of a suitable engineering plastic such as a polyacetal, ABS, PEEK, polyamide, and others, containing a luminescent agent and/or a fluorescent agent as identified previously. The structural upper margin highlighter 46 can include a lower vertical portion 47 and an upper portion 48 which can be substantially continuous and horizontal, as shown in FIG. 6 for corresponding upper portion 37. The upper portion 48 of the structural highlighter 46 can also be substantially vertical as shown in FIGS. 7 and 8 for corresponding upper portion 37. The upper portion 48 can also be as shown in FIGS. 15 and 16 as merely short segments 49 joined to the lower vertical portion 47. Webs 50 can extend from the front surface 51 of the lower portion 47 to the lower surface 52 of the upper horizontal segments 49 to reinforce the angular relationship between the upper portion 48 and lower portion 47. The pegs 53 can be similar in shape to pegs 30 shown in FIGS. 2 and 3. The pegs 53 can include a cap 54 having an outermost edge 55 that can be circular. The distal surface 56 of cap 54 can be essentially a truncated cone extending forward from the outermost edge 55 to a distal end portion 57. The pegs 53 can be secured to the lower vertical portion 47 by various means disclosed in connection with pegs 30, but are preferably formed as a single one-piece unitary molded structure with the remaining portions of the strip curtain supporting structure 46. The use of a structural upper margin highlighter 46 in place of a standard curtain holding apparatus 27 eliminates the need for installation of any separate upper margin highlighter 22 such as is disclosed in connection with FIGS. 2 through 12, thus lowering material costs and lowering installation time.

Figure 17:
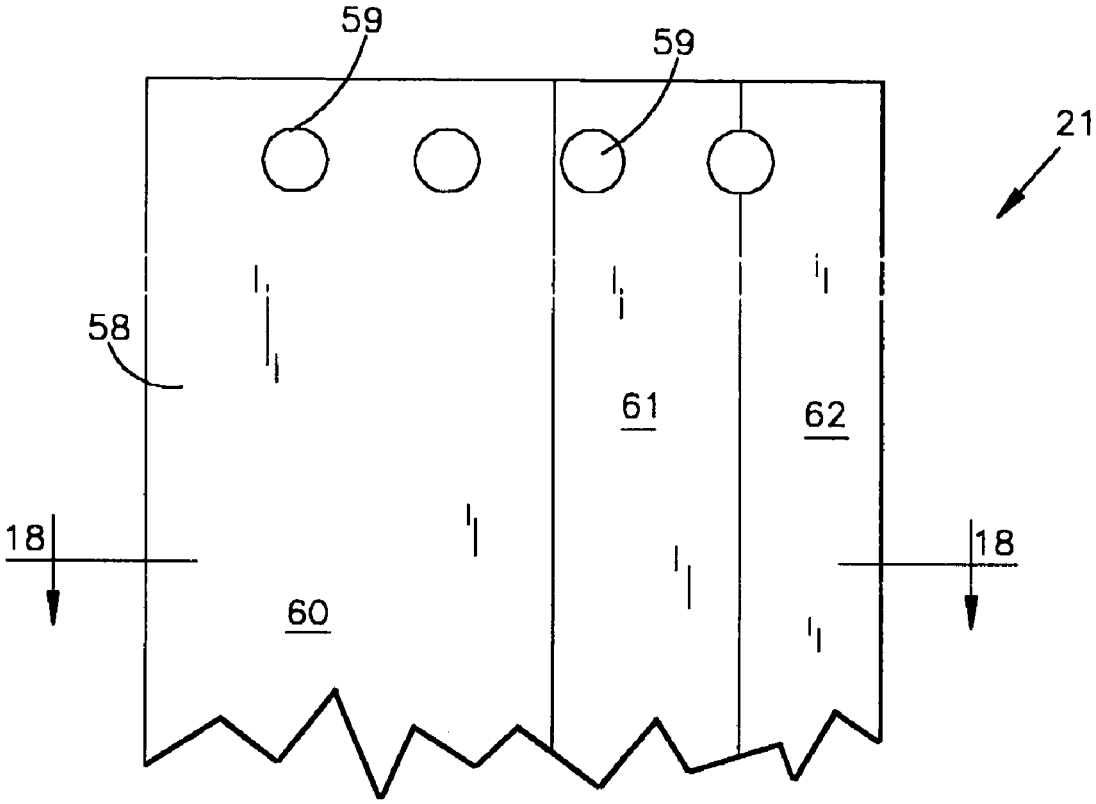
FIG. 17 is a front elevation view of another lateral margin highlighter of the present invention.
Figure 18:
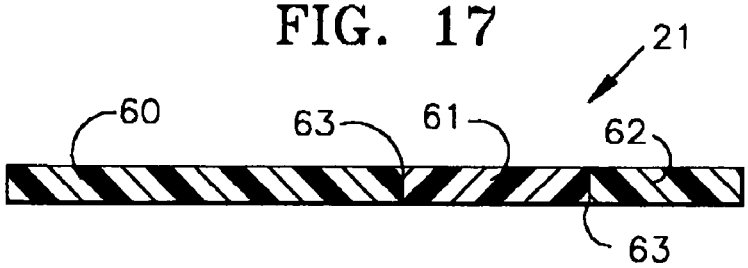
FIG. 18 is a sectional view of the highlighter of FIG. 17 taken along line 18—18.
Figure 19:
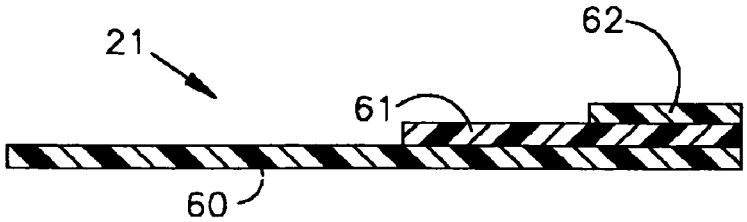
FIG. 19 is an alternative sectional view of the highlighter of FIG. 17 taken along line 18—18.

FIGS. 17 through 19 show a lateral margin highlighter 21 in the form of a vertical strip 58 including a series of openings 59 to permit engagement with a strip holding apparatus 27 or 46 as previously described. The vertical strip 58 includes transparent portions 60 and translucent or opaque portions 61 and 62, containing a luminescent agent or a fluorescent agent, respectively. The portions 60, 61 and 62 can be bonded laminated to each other or co-extruded in any order. That is, portion 61 can contain a luminescent agent while portion 62 contains a fluorescent agent. Alternatively, portion 62 can contain a luminescent agent while portion 61 contains a fluorescent agent. Further either portion 61 or 62 can contain both a luminescent agent and a fluorescent agent. FIG. 18 is a cross-sectional view of a lateral margin highlighter 59 in which lateral edges 63 of the portions 60, 61 and 62 are bonded together or co-extruded so as to form a highlighter 59 of uniform cross-sectional thickness. FIG. 19 is a cross-sectional view a lateral margin highlighter 59 in which the various portions 60, 61 and 62 are laminated face to face to form a layered structure. While the layered structure shown in FIG. 19 might appear to require more material, and thus be more expensive, the support provided by portion 60 for the entire width of the highlighter 59 enables much thinner layers 61 and 62 to be used, which can result in a total lower cost, depending on the thickness of the various layers. The visual pattern of vertical stripes should appear to be similar if not identical in the structures of both FIGS. 18 and 19.

In all the forgoing embodiments, the luminescent and/or fluorescent agent should be present in an amount sufficient to render the margin highlighters 21 and/or 22 highly visible in even low-light situations. It should be understood that the foregoing detailed description should be regarded as illustrative rather than limiting, and the following claims, including all equivalents, define the spirit and scope of this invention.

What is claimed is:

1. An environmental curtain system for at least partially obstructing a passage defined by lateral margins, the system comprising a curtain-holding apparatus to be fixed adjacent to an upper margin of the passage for suspending a plurality of flexible transparent strips of the curtain, each strip having an upper end fixed to the curtain-holding apparatus and a lower end adjacent to a lower margin of the passage, the curtain system further comprising a margin highlighter comprising a plurality of discs fixed adjacent an upper end of the plurality of transparent strips, the margin highlighter including a luminescent or fluorescent agent in sufficient concentration to provide a visible light emission in the event of lighting failure.

2. The environmental curtain system of claim 1, wherein the luminescent or fluorescent agent in the margin highlighter has a color in the range of about 500 to 650 nm.

3. The environmental curtain system of claim 1, wherein the margin highlighter comprises the material forming the curtain-holding apparatus.

4. The environmental curtain system of claim 1, wherein the margin highlighter comprises a plurality of elements extending downward from the curtain-holding apparatus by less than about 30 cm to highlight the passage upper margin.

5. The environmental curtain system of claim 4, wherein the margin highlighter comprises a plurality of discs fixed adjacent an upper end of the plurality of transparent strips.

6. The environmental curtain system of claim 4, wherein the margin highlighter comprises a horizontally extending bar fixed adjacent an upper end of the plurality of transparent strips.

7. An environmental curtain system for at least partially obstructing a passage defined by lateral margins, the system comprising a curtain-holding apparatus to be fixed adjacent to an upper margin of the passage for suspending a plurality of flexible transparent strips of the curtain, each strip having an upper end fixed to the curtain-holding apparatus and a lower end adjacent to a lower margin of the passage, the curtain system further comprising a margin highlighter positioned adjacent to one of the lateral or upper margins, the margin highlighter including a luminescent or fluorescent agent in sufficient concentration to provide a visible light emission in the event of lighting failure, wherein the margin highlighter comprises a plurality of vertically elongated bars fixed adjacent an upper end of the plurality of transparent strips extending downward from the curtain-holding apparatus by less than about 30 cm to highlight the passage upper margin.

8. The environmental curtain system of claim 7, wherein the luminescent or fluorescent agent in the margin highlighter has a color in the range of about 500 to 650 nm.

9. An environmental curtain system for at least partially obstructing a passage defined by lateral margins, the system comprising a curtain-holding apparatus to be fixed adjacent to an upper margin of the passage for suspending a plurality of flexible transparent strips of the curtain, each strip having an upper end fixed to the curtain-holding apparatus and a lower end adjacent to a lower margin of the passage, the curtain system further comprising a margin highlighter positioned adjacent to one of the lateral or upper margins, the margin highlighter including a luminescent or fluorescent agent in sufficient concentration to provide a visible light emission in the event of lighting failure, wherein the margin highlighter comprises a plurality of elements containing the luminescent or fluorescent agent, the elements being secured to one of the laterally outermost strips of the curtain system, the plurality of elements being positioned relative to each other so as to maintain sufficient visibility through the strip to observe any occurrence of movement.

10. The environmental curtain system of claim 9, wherein the elements are arranged as a geometric pattern on an otherwise transparent strip of the curtain system.

11. The environmental curtain system of claim 9, wherein the elements are co-extruded together on an otherwise transparent strip of the curtain system.

12. The environmental curtain system of claim 9, wherein the luminescent or fluorescent agent in the margin highlighter has a color in the range of about 500 to 650 nm.

13. The environmental curtain system of claim 9, wherein the margin highlighter further comprises the material forming the curtain-holding apparatus.

14. The environmental curtain system of claim 9, wherein the margin highlighter further comprises a plurality of elements extending downward from the curtain-holding apparatus by less than about 30 cm to highlight the passage upper margin.

15. The environmental curtain system of claim 9, wherein the margin highlighter further comprises a horizontally extending bar fixed adjacent an upper end of the plurality of transparent strips.

16. The environmental curtain system of claim 9, wherein the margin highlighter further comprises a plurality of discs fixed adjacent an upper end of the plurality of transparent strips.

17. A margin highlighter for use with an environmental strip curtain to delineate a margin of a passage comprising a curtain-holding apparatus including a luminescent or fluorescent agent in sufficient concentration to provide a visible light emission in the event of lighting failure, and a curtain strip suspended from the curtain-holding apparatus, the curtain strip including a plurality of elements containing the luminescent or fluorescent agent, the elements being secured to one of the laterally outermost strips of the curtain system, the plurality of elements being positioned relative to each other so as to maintain sufficient visibility through the strip to observe any occurrence of movement.

18. The margin highlighter of claim 17, wherein the elements are arranged as a geometric pattern on an otherwise transparent curtain strip.

19. The margin highlighter of claim 17, wherein the elements are co-extruded together on an otherwise transparent curtain strip.

20. An environmental curtain system for at least partially obstructing a passage defined by lateral margins, the system comprising a curtain-holding apparatus to be fixed adjacent to an upper margin of the passage including a plurality of outwardly extending pegs suspending flexible transparent strips of the curtain, each strip having an upper end coupled to at least two of the outwardly extending pegs and a lower end adjacent to a lower margin of the passage, a retaining structure having a back surface to retain the flexible transparent strips in coupled relation to the pegs, and a buffer for preventing direct interaction between the flexible transparent strips and a back surface of a retaining structure, the buffer including a luminescent or fluorescent agent in sufficient concentration to provide a visible light emission in the event of lighting failure.

21. The environmental curtain system of claim 20 wherein the buffer comprises a plurality of discrete elements, each element coupled to a single peg.

22. The environmental curtain system of claim 20 wherein the buffer comprises a laterally extending element coupled to the pegs holding a plurality of the flexible transparent strips.

23. The environmental curtain system of claim 21 or 22 wherein the buffer includes a luminescent or fluorescent agent in sufficient concentration to provide a visible light emission in the event of lighting failure.

* * * * *